US006510636B1

(12) United States Patent
Abramson et al.

(10) Patent No.: US 6,510,636 B1
(45) Date of Patent: Jan. 28, 2003

(54) PROTECTIVE DISPLAY SYSTEM

(76) Inventors: Brian Abramson, 365 Kennedy Road South, Bramp Ontario (CA), L6W 3H3; Steven Ferguson, 484 Avenue Road, Suite #1009, Toronto Ontario (CA), M4V 2J4

( * ) Notice: Subject to any disclaimer, the term of this patent is extended or adjusted under 35 U.S.C. 154(b) by 0 days.

(21) Appl. No.: 09/608,948

(22) Filed: Jun. 30, 2000

(51) Int. Cl.[7] ..... G09F 3/18
(52) U.S. Cl. ..... 40/661; 40/642.02
(58) Field of Search ..... 40/641, 642, 651, 40/661, 661.06

(56) References Cited

U.S. PATENT DOCUMENTS 4,736,538 A * 4/1988 Pierce et al. ..... 40/158
4,821,437 A * 4/1989 Abramson et al. ..... 40/642
4,829,691 A * 5/1989 Manjos et al. ..... 40/661
5,115,855 A * 5/1992 Lindblom et al. ..... 160/135
5,408,775 A * 4/1995 Abramson et al. ..... 40/642
5,799,427 A * 9/1998 Abramson et al. ..... 40/642.02
5,992,665 A * 11/1999 Deeter ..... 220/23.4
6,017,164 A * 1/2000 Abbott ..... 402/73

* cited by examiner

*Primary Examiner*—Christopher P. Schwartz

(57) ABSTRACT

A protective display system for displaying a plurality of substantially planar display cards and methods for making the same are provided. The unitary protective display system comprises at least a first pair of transparent panels, and a flexible living hinge. Each of the panels has a front face, a back face, and at least one straight peripheral edge. At least one of the panels is an envelope which is adapted to receive at least one display card. Each one of the panels are opposed to one another such that each of the at least one straight peripheral edge are opposed edges. The flexible living hinge is located along at least a portion of the straight peripheral edge of each panel, and is interposed therebetween such that at least one of the envelopes is rotatable about the flexible living hinge. The flexible living hinge also has greater flexibility than each of the panels.

21 Claims, 3 Drawing Sheets

PROTECTIVE DISPLAY SYSTEM

FIELD OF THE INVENTION

This invention relates to the field of display devices, and in particular, to display devices which function to hold and protect a display card(s) which, in turn, provide the desired information to a prospective customer, or for the user.

1. Background of the Invention

The field of display devices is a crowded art and encompasses a wide variety of differing embodiments. Typically, display systems are used both by merchandisers and individuals. On the level of the merchandiser in a large chain store, display systems allow a customer to research the product without assistance from a sales clerk. They generally comprise at least one display card, protected by a transparent film, that visibly displays product information about a product. This product information may be in a variety of forms, for example, a photograph or a written description. Display systems may include a means for mounting the display system at the desired location, e.g. on a shelving unit, or they may use a pre-existing mounting system. At the level of the individual consumer, display systems are often a means to display collectibles, typically collector cards.

2. Description of the Prior Art

U.S. Pat. No. 4,821,437 issued to ABRAMSON and BAKE teaches a merchandise display system. The system includes supports means for holding display information cards where the support means is an extrusion mountable on a wall or other surface. The support means includes flexible attachment means that allows for the manipulation of the information display cards, where the flexible attachment means is generally a plurality of flexible strips extending from the support means. The free ends of the attachment means are adapted to hold the information display cards.

U.S. Pat. No. 4,829,691 issued to MANJOS teaches a card display holder and protector. This apparatus comprises first and second transparent panels connected to one another by a common hinge line. The display holder receives the card to be displayed into the recessed portion of the first panel. The second panel has a projecting surface so as to engage the first panel and to maintain the display holder in a closed position.

U.S. Pat. No. 5,408,775 issued to ABRAMSON and STEWART teaches a merchandise information system. This systems comprises a rigid base and a plurality of spaced apart flexible webs, where the flexible webs depend from the rigid base, and display items may be attached to the lower end of the webs. The display items are typically clear plastic envelopes which are adapted to receive display cards or the like. The display items may be viewed through either the front or rear surface of the envelope as the envelopes may be rotated about the respective flexible webs.

U.S. Pat. No. 5,799,427 issued to ABRAMSON and STEWART teaches an overlapping merchandise information display module. This system comprises a rigid base, and a plurality of flexible webs which depend from the lower edge of the rigid base. A series of overlapping display items are attached to the lower ends of each of the webs respectively to display one side of the item. The display items may be rotated about the flexible webs so as to display the other side of the item.

U.S. Pat. No. 5,992,665 issued to DEETER teaches a portable display case. The apparatus is transparent and has a plurality of compartments for storage, display, and transport of display items. Each case had a transparent plastic cover hingedly connected to the case so as to cover the open front face. Furthermore, each case may be attached to an adjacent case, vertically disposed, by means of a tongue and groove type of fastener.

SUMMARY OF THE INVENTION

In accordance with one aspect of the present invention, there is provided a protective display system for displaying a plurality of substantially planar display cards. The protective display system of the present invention comprises at least a first pair of transparent panels, and a flexible living hinge. Each one of the at least a first pair of transparent panels has a front face, a back face, and at least one straight peripheral edge. Furthermore, at least one of the at least a first pair of transparent panels is an envelope which is adapted to receive at least one display card. Each one of the at least a first pair of transparent panels is opposed to one another such that each of the at least one straight peripheral edges are opposed edges. The flexible living hinge is located along at least a portion of the at least one straight peripheral edge of each one of the at least a first pair of transparent panels. Still further, the flexible living hinge is interposed between the at least one straight peripheral edge of each one of the at least a first pair of transparent panels. The at least a first pair of transparent panels is rotatable about the flexible living hinge. The protective display system of the present invention is an unitary structure. Also, the flexible living hinge has greater flexibility than each one of the at least a first pair of transparent panels.

In an alternative embodiment, the at least a first pair of transparent panels comprises a first envelope, and a second envelope. Furthermore, the flexible living hinge is interposed between the first and second envelopes.

In another embodiment of the present invention, the at least a first pair of transparent panels comprises a first envelope, a second envelope, and a third envelope. Here, the flexible living hinge is interposed between the first and second envelopes, the second and third envelopes, and the third and first envelopes. It is important to note that the flexible living hinge may be extruded.

As an alternative, the protective display system comprises a first envelope, a second envelope, a third envelope, and a flexible living hinge which has a star configuration having three extending webs, and is such that the at least one straight peripheral edge of each one of the envelopes is welded to a respective one of the extending webs.

In a second alternative embodiment of the present invention, the protective display system comprises a first pair of transparent panels and a respective first flexible hinge, a second pair of transparent panels and a respective second flexible living hinge. Each of the first and second flexible living hinges is interposed between each of the respective first and second pair of transparent panels. The first flexible living hinge is placed on top of the second flexible living hinge, and is welded one to another such that each of the first and second flexible living hinges maintains its flexibility when welded one to another.

In the alternative embodiment, the protective display system comprises two pairs of transparent envelopes and a flexible living hinge, and where the flexible living hinge has a star configuration having four extending webs. The protective display system is such that the at least one straight peripheral edge of each one of the envelopes is welded to a respective one of the extending webs.

The flexible living hinge may fulfill the role of a rip stop, where the rip stop functions to impede a tear in the flexible living hinge from progressing down the entire length of the flexible living hinge. The rip stop comprises a plurality of rows of closely spaced inwardly and outwardly directed projections, and each of the plurality of rows is perpendicular to the respective straight peripheral edge. Also, it is noted that the plurality of rows is located along the length of the flexible living hinge.

Typically, the at least one envelope of the protective display system is adapted to receive two display cards, back-to-back. When the first envelope receives two display cards, the first display card is visible through the front face of the first envelope. Furthermore, the second display card received within the first envelope is visible through the back face of the first envelope when the first envelope is rotated at least 90 degrees about the flexible living hinge. Still further, when the first envelope is rotated at least 90 degrees about the flexible living hinge, the at least one display card within the second envelope is visible through the front face of the second envelope.

The first and second envelopes of the protective display system may be stepped such that, when the back face of the first envelope is contiguous to the front face of the second envelope, an edge of the second envelope which is remote from the flexible living hinge extends a distance below an edge of the first envelope which is remote from the flexible living hinge such that a portion of the second envelope is visible.

In one embodiment of the present invention, the first, second, and third envelopes are stepped, such that, when the back face of the first envelope is contiguous to the front face of the second envelope, and the back face of the second envelope is contiguous to the front face of the third envelope, an edge of the second envelope which is remote from the flexible living hinge extends a distance below an edge of the first envelope which is remote from the flexible living hinge, and an edge of the third envelope which is remote from the flexible living hinge extends a distance below an edge of the second envelope such that a portion of each of the second and third envelopes is visible.

The stepped nature of the envelopes illustrates to the consumer that there is additional display information beyond the first visible display card. In addition, at the merchandising level, it allows the merchandiser to display large quantities of information that the consumer may view at their leisure without requiring assistance from store staff. At the individual level, collectibles may be displayed and mounted on a refrigerator door for example, where the first item in the collection is visible, and if persons seeing that first collectible are intrigued or interested, the stepped nature of the display card clearly shows that there are additional display cards that may be viewed upon rotation of the first display card.

While the protective display system may be free standing, the user may also find it desirable to mount the protective display system on a desired surface. The protective display system may further includes a hanging strip for attaching the protective display system to an existing base. The hanger strip is located along at least a portion of the at least one straight peripheral edge of one of the at least a first pair of transparent panels. Furthermore, the hanger strip is parallel to the flexible living hinge.

As an alternative, or in addition to the hanger strip, the protective display system may include a fastening means. The fastening means is generally located on the back face of the rearmost envelope and is chosen from the group consisting of a magnetic strip, a hook and loop connector strip, double sided tape, and combinations thereof.

The manufacture of the protective display system involves the unexpected application of the joining of two different materials, usually a more rigid PVC and a more flexible PVC. Each one of the at least a first pair of transparent panels is formed from a rigid PVC and the flexible living hinge is formed from a flexible PVC. Still further, the front face and back face of each one of the at least a first pair of transparent panels, and the flexible living hinge may be formed using a coextrusion process.

In the alternative, the at least a first pair of transparent panels may be vacuum formed, and the at least one straight peripheral edge of each one of the at least a first pair of transparent panels is welded one to another, and to the flexible living hinge.

Another object of the present invention is to provide a method of manufacturing the protective display system. The protective display system would be, of course, as described above. In particular, the at least a first pair of transparent panels of the protective display system comprises a first envelope and a second envelope, and the flexible living hinge is interposed between the first and second envelopes. The method comprises the steps of:

(1) placing the first and second envelopes in a die such that the at least one straight peripheral edge of the first envelope is opposed to the at least one straight peripheral edge of the second envelope, and each of the envelopes is in the same plane.

(2) closing and heating the die to a temperature above the tempering temperature of the flexible living hinge, so as to interpose the flexible living hinge between the at least one straight peripheral edge of the first envelope and the at least one straight peripheral edge of the second envelope, where the at least one straight peripheral edge of the second envelope is opposed to the at least one straight peripheral edge of the first envelope, by the addition of a flexible PVC.

(3) opening and lifting the die after interposing the flexible living hinge between the respective at least one straight peripheral edge of each of the first and second envelopes, while the flexible living hinge remains above its tempering temperature.

(4) rotating one of the first and second envelopes about the flexible living hinge such that the back face of the first envelope is contiguous to the front face of the second envelope.

(5) cooling the protective display system and trimming the excess material from the flexible living hinge.

It is important to note that the rotation of one of the first and second envelopes about the flexible living hinge is carried out while the flexible living hinge is above its tempering temperature, and so that after cooling, an elastic memory for the flexible living hinge is created, and the first and second envelopes are in the desired position. The elastic memory of the flexible living hinge is such that it encourages each of the first and second envelopes to return to the desired position after each of the first and second envelopes is rotated about the flexible hinge.

In keeping with the present invention, another method of making the protective display system is provided. This method comprises the steps of:

(1) placing the protective display system such that the first envelope, the second envelope, and the flexible living hinge are all located in the same plane.

(2) reheating the flexible living hinge to a temperature above its tempering temperature.

(3) rotating one of the first and second envelopes about the flexible living hinge such that the back face of the first envelope is contiguous to the front face of the second envelope.

(4) cooling the protective display system.

Similar to the first method of manufacture of the protective display system described previously, the rotation of one of the first and second envelopes about the flexible living hinge is also carried out herein while the flexible living hinge is above its tempering temperature. Thus, after cooling, an elastic memory for the flexible living hinge is created, and the first and second envelopes are in the desired position. The desired position is defined as the back face of the first envelope and the front face of the second envelope being contiguous to one another. When the protective display system is cooled in this desired position, the elastic memory of the flexible living hinge is such that it encourages each of the first and second envelopes to return to the desired position after being rotated about the flexible living hinge.

BRIEF DESCRIPTION OF THE DRAWINGS

The novel features which are believed to be characteristic of the present invention, as to its structure, organization, use and method of operation, together with further objectives and advantages thereof, will be better understood from the following drawings in which a presently preferred embodiment of the invention will now be illustrated by way of example. It is expressly understood, however, that the drawings are for the purpose of illustration and description only and are not intended as a definition of the limits of the invention. Embodiments of this invention will now be described by way of example in association with the accompanying drawings in which.

DETAILED DESCRIPTION OF THE PREFERRED EMBODIMENTS

Figure 1:
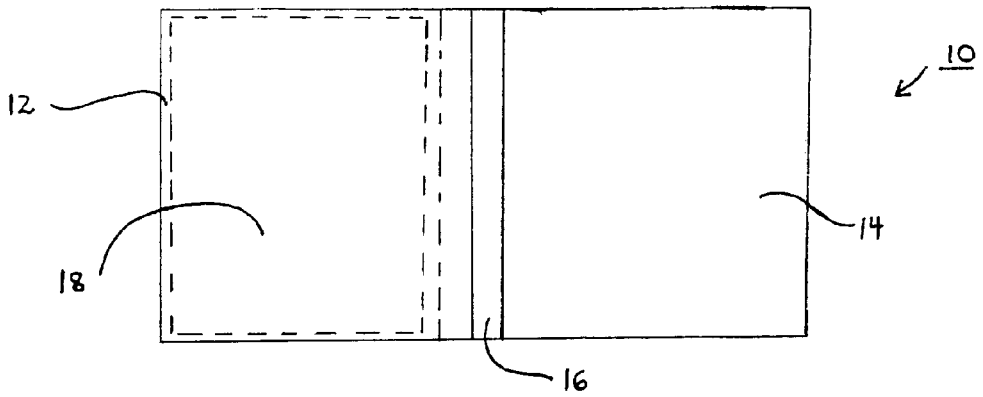
FIG. 1 is a front view of a first embodiment of the protective display system.

Referring now to the drawings, there is illustrated a protective display system, generally designated by reference numeral 10. Alternative embodiments 30, 40 and 50 will be discussed hereafter.

Figure 11:
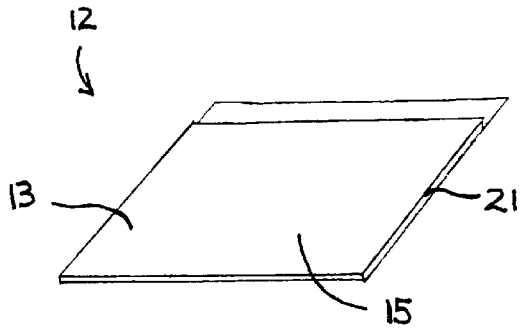
FIG. 11 is a perspective view of an envelope in keeping with the present invention.

Turning first to FIG. 1, a front view of the protective display system 10 is shown. The protective display system 10 comprises at least a first pair of transparent panels 12 and 14, and a flexible living hinge. Each one of the at least a first pair of transparent panels 12 and 14 has a front face 13, a back face 15, and at least one straight peripheral edge, as shown in FIG. 11. Furthermore, at least one of the first pair of transparent panels 12 and 14 is an envelope. As seen in FIG. 11, reference numeral 12 refers to an envelope. The envelope 12 is adapted to receive at least one display card 18.

Figure 2:
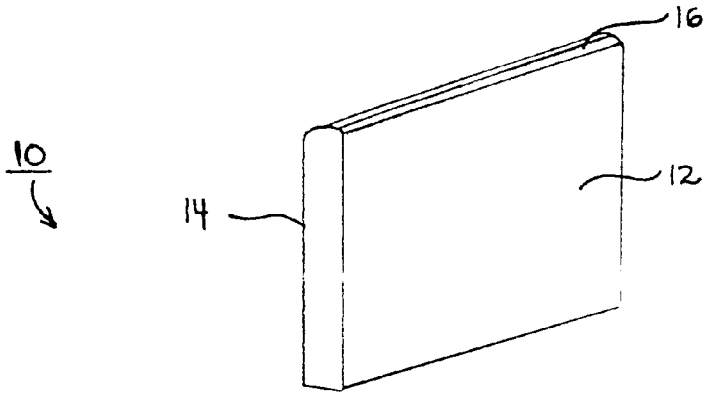
FIG. 2 is a perspective view of the first embodiment of the protective display system.

Referring back to FIG. 1, each one of the at least a first pair of transparent panels 12 and 14 is opposed to one another such that each of the at least one straight peripheral edges are opposed edges. Still further, the flexible living hinge 16 is located along at least a portion of the at least one straight peripheral edge of each one of the at least a first pair of transparent panels 12, and 14. The flexible living hinge 16 is interposed between the at least one straight peripheral edge of each one of the at least a first pair of transparent panels 12 and 14 (FIG. 2). It is important to note that the at least one envelope 12 of the at least a first pair of transparent panels 12 and 14 is rotatable about the flexible living hinge 16.

Each of the protective display systems described herein is an unitary structure. Moreover, the flexible living hinge 16 has greater flexibility than each one of the at least a first pair of transparent panels 12, and 14.

Figure 3:
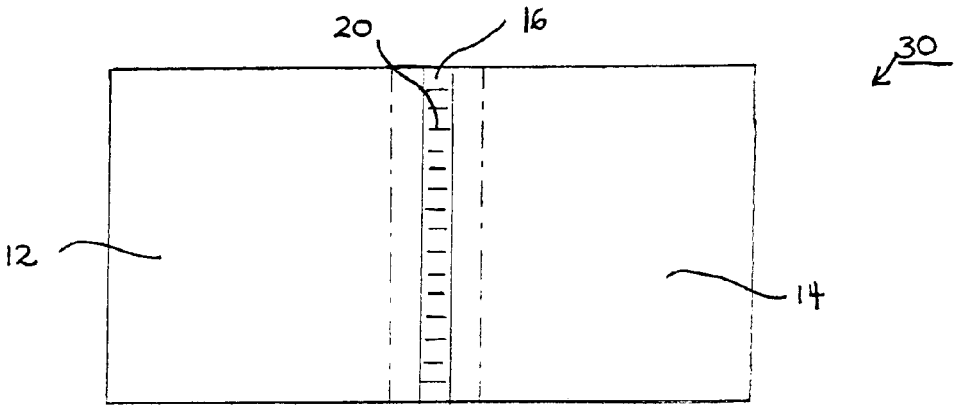
FIG. 3 is a modified front view of the first embodiment of the protective display system.

FIG. 3 shows a first alternative embodiment of the present invention, the at least a first pair of transparent panels 12 and 14 of the protective display system 30 comprises a first envelope 12, and a second envelope 14, and a flexible living hinge 16 in which the flexible living hinge 16 is interposed between the first and second envelopes 12 and 14 respectively. As shown here, the flexible living hinge 16 fulfills the role of a rip stop 20 in which the rip stop 20 functions to impede a tear in the flexible living hinge 16. The rip stop 20 comprises a plurality of rows of closely spaced inwardly and outwardly directed projections, where each of the plurality of rows 20 is perpendicular to the respective straight peripheral edges. The plurality of rows 20 is located along the length of the flexible living hinge 16.

The at least one envelope 12, as shown in FIG. 11, is adapted to receive two display cards 18 back to back. Further, each of the at least one envelope 12 of the at least a first pair of transparent panels 12 and 14 is formed such that there is a gap between the front face 13 and the back face 15 of each of the at least one envelop 12 of the at least a first pair of transparent panels 12 and 14 so as to accommodate the receiving of at least one display card 18.

Figure 4:
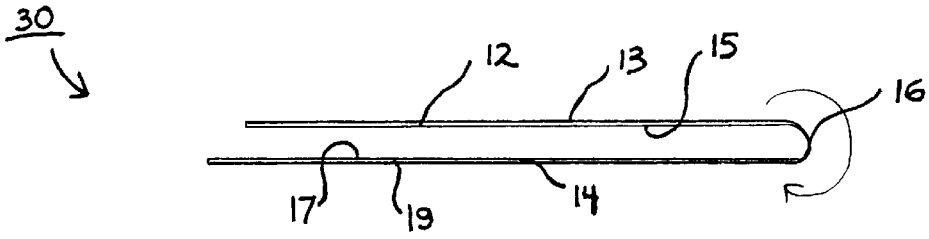
FIG. 4 is a side view of the first embodiment of the protective display system.
Figure 5:
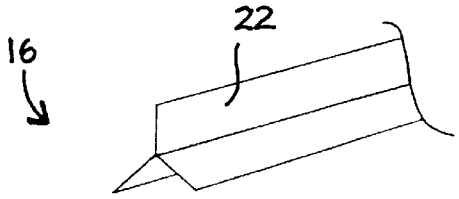
FIG. 5 is a perspective view of a flexible living hinge.

When the first envelope 12 receives two display cards, the first display card is visible through the front face 13 of the first envelope 12, when the back face 15 of the first envelope is contiguous to the front face 17 of the second envelope 14 as shown in FIG. 4. The second display card received within the first envelope 12 is visible through the back face 15 of the first envelope 12 when the first envelope 12 is rotated about the flexible living hinge 16 at least 90°. The second envelope 14 is adapted to receive at least [a third] one display card. The at least one display card within the second envelope 14 is visible through the front face 17 of the second envelope 14, when the first envelope 12 is rotated at least 90° about the flexible living hinge 16.

Figure 9:
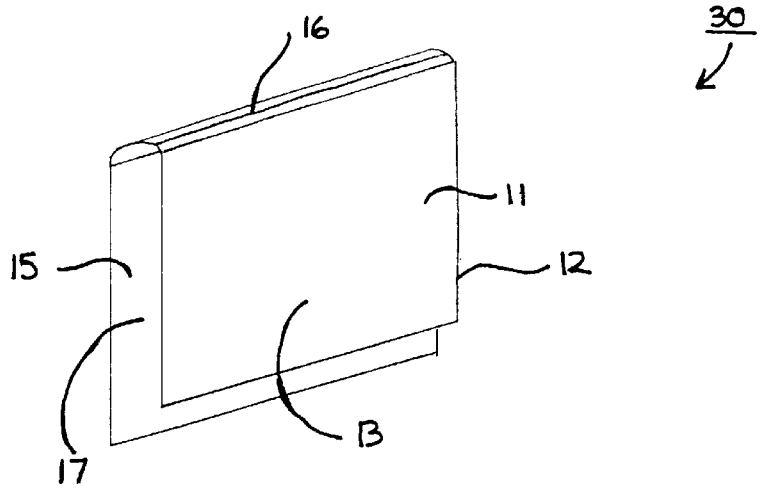
FIG. 9 is a perspective view of another embodiment of the protective display system.

In FIG. 9, the protective display system 30 is shown. Here, the first 12 and second 14 envelopes are stepped. When the back face 15 of the first envelope is contiguous to the front face 17 of the second envelope 14, an edge of the second envelope which is remote from the flexible living hinge 16 extends a distance below an edge of the first envelope 12 which is remote from the flexible living hinge 16 such that a portion of the second envelope 14 is visible.

Figure 7:
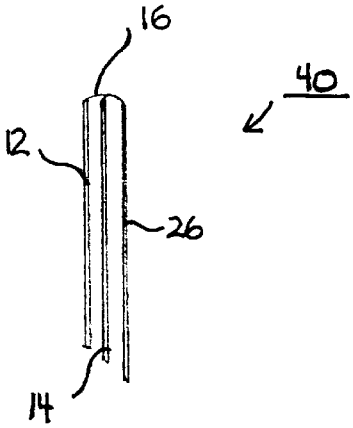
FIG. 7 is a side view of another embodiment of the protective display system.
Figure 8:
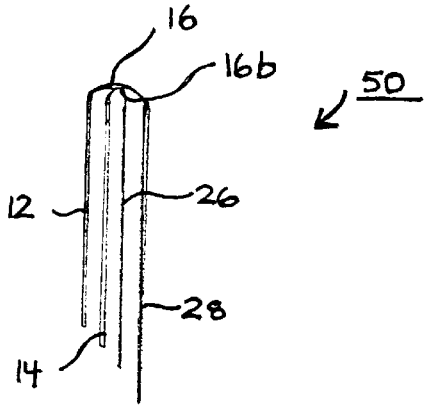
FIG. 8 is a side view of an alternative embodiment of the protective display system.

Each of the alternative embodiments of the protective display system 40, 50 shown in FIGS. 7 and 8 respectively, also incorporate a stepped configuration of the at least a first pair of transparent panels 12 and 14. In FIG. 7, protective display system 40 is shown. The protective display system 40 comprises a first envelope 12, a second envelope 14, and a third envelope 26. The first, second, and third envelopes 12, 14 and 26 respectively are stepped, such that, when the back face of the first envelope 12 is contiguous to the front face of the second envelope 14, and the back face of the second envelope 14 is contiguous to the front face of the third envelope 26, an edge of the second envelope 14 which is remote from the flexible living hinge 16 extends a distance below an edge of the first envelope 12 which is remote from the flexible living hinge 16, and an edge of the third envelope 26 which is remote from the flexible living hinge 16 extends a distance below an edge of the second envelope 14 such that a portion of each of the second and third envelopes 14-and 26 is visible. The flexible living hinge 16 is interposed between the first 12 and second 14 envelopes, the second 14 and third 26 envelopes, and the third 26 and first 12 envelopes. The flexible living hinge 16 may be extruded. However, as an alternative, the flexible living hinge 16 may have a star configuration having three extending webs 22, and is such that the at least one straight peripheral edge of each one of the [first 12, second 14, and third 26] envelopes is welded to a respective one of the extending webs 22.

Figure 6:
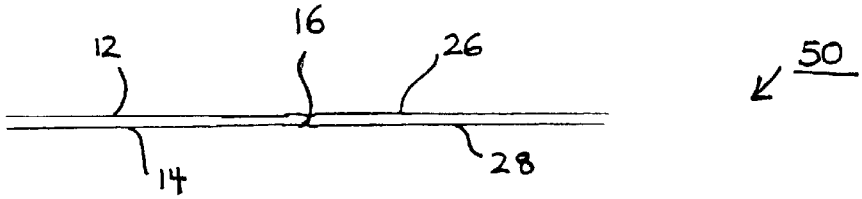
FIG. 6 is a side view of an alternative embodiment of the protective display system.

A third alternative embodiment of the protective display system 50 is shown in FIGS. 6 and 8. The protective display system comprises a first pair of transparent panels 12, and 14, and a respective first flexible living hinge 16, a second pair of transparent panels 26, and 28 and a respective second flexible living hinge 16*b*. Similar to FIG. 7, the first, second, third, and fourth envelopes 12, 14, 26 and 28 are stepped, such that when the back face of one of the envelopes is contiguous to the front face of a consecutive envelope, an edge of the consecutive envelope which is remote from the flexible living hinge 16 extends a distance below an edge of the previous envelope such that a portion of each of the consecutive envelopes is visible. Here, each of the first and second flexible living hinges 16*a* and 16*b* is interposed between each of the respective first and second pair of transparent panels. Furthermore, the first flexible living hinge 16 is placed on top of the second flexible living hinge 16*b*, and is welded one to another, as shown in FIG. 8. It is important to note that each of the first and second flexible living hinges 16*a* and 16*b* maintains its flexibility when welded one to another.

In an alternative embodiment shown in FIG. 6, the protective display system 50 comprises two pairs of transparent envelopes and a flexible living hinge 16 where the flexible living hinge 16 has a star configuration having four extending webs, and is such that at least one straight peripheral edge of each of the first 12, second 14, third 26, and fourth 28 envelopes is welded to a respective one of the four extending webs.

Figure 10:
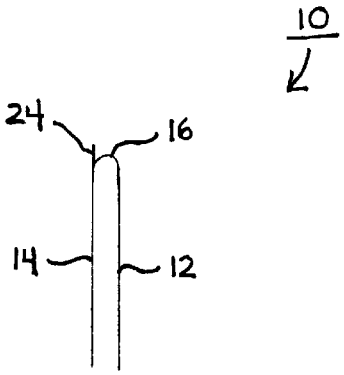
FIG. 10 is a side view of the first embodiment of the protective display system.

In FIG. 10 the protective display system 10 incorporates a hanger strip 24 for attaching the protective display system 10 to an existing base. The hanger strip 24 is located along at least a portion of the at least one peripheral edge of one of the at least a first pair of transparent panels 12 and 14. Still further, the hanger strip 24 is parallel to the flexible living hinge 16. As an alternative, or in addition to the hanger strip 24, the protective display system 10 may also include fastening means which is generally located on the back face of the rearmost envelope. The fastening means may be chosen from the group consisting of a magnetic strip, a hook and loop connector strip, double-sided tape or combinations thereof.

Typically, each one of the at least a first pair of transparent panels 12 and 14 in each of the protective display systems described herein is formed from a rigid PVC, and the flexible living hinge 16 is formed from a flexible PVC.

In an alternative embodiment of the present invention, the front face 13 and the back face 15 of each one of the at least a first pair of transparent panels 12 and 14, and the flexible living hinge 16 are formed using a co-extrusion process.

Still further, in a particular embodiment of the present invention, the at least a first pair of transparent panels 12 and 14 may be vacuum formed, and the at least one straight peripheral edge of each one of the at least a first pair of transparent panels 12 and 14 is welded one to another, and to the flexible living hinge 16.

In keeping with the provisions of the present invention, the inventor herein provides a method of making a protective display system. The protective display system, would be, of course, as described above. In particular, the at least a first pair of transparent panels 12 and 14 of the protective display system comprises a first envelope 12 and a second envelope 14. The flexible living hinge 16 is interposed between the first and second envelopes 12 and 14. The method comprises the steps of:

(1) placing the first envelope 12 and the second envelope 14 in a die such that the at least one straight peripheral edge of the first envelope 12 is opposed to the at least one straight peripheral edge of the second envelope 14, and each of the envelopes 12 and 14 is in the in the same plane;

(2) closing and heating the die to a temperature above the tempering temperature of the flexible living hinge 16, so as to interpose the flexible living hinge 16 between the at least one straight peripheral edge of the first envelope 12 and the at least one straight peripheral edge of the second envelope 14, where the at least one straight peripheral edge of the second envelope 14 is opposed to the at least one straight peripheral edge of the first envelope 12, by the addition of a flexible PVC;

(3) opening and lifting the die after interposing the flexible living hinge between the respective at least one straight peripheral edge of each of the first and second envelopes 12 and 14 respectively, while the flexible living hinge 16 remains above its tempering temperature;

(4) rotating one of the first and second envelopes 12 and 14 about the flexible living hinge such that the back face 15 of the first envelope 12 is contiguous to the front face 17 of the second envelope 14; and (5) cooling the protective display system and trimming the excess material from the flexible living hinge 16.

In step (4), the rotation of one of the first and second envelopes 12 and 14 respectively about the flexible living hinge 16 is carried out while the flexible living hinge 16 is above its tempering temperature. Thus, after cooling the protective display system in step (5), an elastic memory for the flexible living hinge 16 is created, and the first and second envelopes 12 and 14 are in the desired position. The elastic memory of the flexible living hinge 16 is such that it encourages each of the first and second envelopes 12 and 14 to return to the desired position after each of the first and second envelopes 12 and 14 is rotated about the flexible living hinge 16.

In keeping with another provision of the present invention, an alternative method of making a protective display system is provided by the inventors herein. The protective display system would be, of course, as described above. The method comprises the steps of:

(1) placing the protective display system such that the first envelope 12, the second envelope 14, and the flexible living hinge 16 are all located in the same plane;

(2) reheating the flexible living hinge 16 to a temperature above its tempering temperature, (3) rotating one of the first and second envelopes 12 and 14 respectively about the flexible living hinge 16 such that the back face 15 of the first envelope 12 is contiguous to the front face 17 of the second envelope 14; and (4) cooling the protective display system.

Here, in step (3), the rotation of one of the first and second envelopes 12 and 14 respectively about the flexible living hinge 16 is carried out while the flexible living hinge 16 is above its tempering temperature. Thus, after cooling the protective display system in step (4), an elastic memory for the flexible living hinge 16 is created, and the first and second envelopes 12 and 14 are in the desired position. It is important to note that the elastic memory of the flexible living hinge 16 is such that it encourages each of the first and second envelopes 12 and 14 to return to the desired position after being rotated about the flexible living hinge 16.

Other modifications and alterations may be used in the design and manufacture of the apparatus of the present invention without departing from the spirit and scope of the accompanying claims.

Throughout this specification and the claims which follow, unless the context requires otherwise, the word "comprise", and variations such as "comprises" or "comprising", will be understood to imply the inclusion of a stated integer or step or group of integers or steps but not to the exclusion of any other integer or step or group of integers or steps.

Moreover, the word "substantially" when used with an adjective or adverb is intended to enhance the scope of the particular characteristic; e.g., substantially planar is intended to mean planar, nearly planar and/or exhibiting characteristics associated with a planar element.

What is claimed is:

1. A protective display system for displaying a plurality of substantially planar display cards comprising:

at least a first pair of transparent panels and a flexible living hinge;

wherein each one of said at least a first pair of transparent panels has a front face, a back face, and at least one straight peripheral edge, and wherein at least one of said at least a first pair of transparent panels is an envelope which is adapted to receive at least one display card;

wherein each one of said at least a first pair of transparent panels is opposed to one another such that each of said at least one straight peripheral edges are opposed edges;

wherein said flexible living hinge is located along at least a portion of said at least one straight peripheral edge of each one of said at least a first pair of transparent panels wherein said flexible living hinge is interposed between said at least one straight peripheral edge of each one of said at least a first pair of transparent panels, and wherein said at least one envelope of said at least a first pair of transparent panels is rotatable about said flexible living hinge;

wherein said protective display system is an unitary structure; and wherein said flexible living hinge has greater flexibility than each one of said at least a first pair of transparent panels.

2. The protective display system of claim 1, wherein said at least a first pair of transparent panels comprises a first envelope and a second envelope, and wherein said flexible living hinge is interposed between said first and second envelopes.

3. The protective display system of claim 2, wherein when said first envelope is rotated at least 90 degrees about said flexible living hinge, said at least one display card within said second envelope is visible through said front face of said second envelope.

4. The protective display system of claim 2, wherein said first envelope and said second envelope are stepped, such that, when said back face of said first envelope is contiguous to said front face of said second envelope, an edge of said second envelope which is remote from said flexible living hinge extends a distance below an edge of said first envelope which is remote from said flexible living hinge such that a portion of said second envelope is visible.

5. The protective display system of claim 1, wherein said at least a first pair of transparent panels comprises a first envelope, a second envelope, and a third envelope, wherein said flexible living hinge is interposed between said first and second envelopes, said second and third envelopes, and said first and third envelopes, and wherein said flexible living hinge is extruded.

6. The protective display system of claim 5, wherein said first, second, and third envelopes are stepped, such that, when said back face of said first envelope is contiguous to said front face of said second envelope, and said back face of said second envelope is contiguous to said front face of said third envelope, an edge of said second envelope which is remote from said flexible living hinge extends a distance below an edge of said first envelope which is remote from said flexible living hinge, and an edge of said third envelope which is remote from said flexible living hinge extends a distance below an edge of said second envelope such that a portion of each of said second and third envelopes is visible.

7. The protective display system of claim 1, wherein said at least one envelope is adapted to receive two display cards, back to back.

8. The protective display system of claim 7, wherein when said first envelope receives two display cards, such that said first display card is visible through said front face of said first envelope, and wherein said second display card is visible through said back face of said first envelope when said first envelope is rotated at least 90 degrees about said flexible living hinge.

9. The protective display system of claim 1, wherein said protective display system comprises a first pair of transparent panels and a respective first flexible living hinge, a second pair of transparent panels and a respective second flexible living hinge, wherein each of said first and second flexible living hinges is interposed between each of said respective first and second pairs of transparent panels; and wherein said first flexible living hinge is placed on top of said second flexible living hinge, and is welded one to another such that each of said first and second flexible living hinges maintains its flexibility when welded one to another.

10. The protective display system of claim 9, wherein said first, second, third, and fourth envelopes are stepped, such that, when said back face of one of said envelopes is contiguous to said front face of a consecutive envelope, an edge of said consecutive envelope which is remote from said flexible living hinge extends a distance below an edge of the previous envelope such that a portion of each said consecutive envelope is visible.

11. The protective display system of claim 1, wherein said protective display system comprises a first envelope, a second envelope, a third envelope, and a flexible living hinge, and wherein said flexible living hinge has a star configuration having three extending webs, and is such that said at least one straight peripheral edge of each one of said envelopes is welded to a respective one of said extending webs.

12. The protective display system of claim 1, wherein said protective display system comprises two pairs of transparent envelopes and a flexible living hinge, and wherein said flexible living hinge has a star configuration having four extending webs, and is such that said at least one straight peripheral edge of each one of said envelopes is welded to a respective one of said extending webs.

13. The protective display system of claim 1, wherein said flexible living hinge fulfills the role of a rip stop, wherein said rip stop comprises a plurality of rows of closely spaced inwardly and outwardly directed projections, wherein each of said plurality of rows is perpendicular to said respective straight peripheral edges, and wherein said plurality of rows is located along the length of said flexible living hinge.

14. The protective display system of claim 1, wherein each of said at least one envelope of said at least a first pair of transparent panels is formed such that there is a gap between said front face and said back face of each of said at least one envelope of said at least a first pair of transparent panels so as to accommodate the receiving of said at least one display card.

15. The protective display system of claim 1, further includes a hanger strip wherein said hanger strip is located along at least a portion of said at least one straight peripheral edge of each one of said at least a first pair of transparent panels, and wherein said hanger strip is parallel to said flexible living hinge.

16. The protective display system of claim 1, further includes fastening means wherein said fastening means is located on said back face of the rearmost envelope, and wherein said fastening means is chosen from the group consisting of a magnetic strip, double sided tape, hook and loop connector, and combinations thereof.

17. The protective display system of claim 1, wherein each one of said at least a first pair of transparent panels is formed from a rigid PVC, and wherein said flexible living hinge is formed from a flexible PVC.

18. The protective display system of claim 1, wherein said front face and said back face of each one of said at least a first pair of transparent panels, and said flexible living hinge are formed using a co-extrusion process.

19. The protective display system of claim 1, wherein said at least a first pair of transparent panels are vacuum formed, and wherein said at least one straight peripheral edge of each one of said at least a first pair of transparent panels is welded one to another, and to said flexible living hinge.

20. A method of making a protective display system, wherein said protective display system comprises:

at least a first pair of transparent panels and a flexible living hinge;

wherein each one of said at least a first pair of transparent panels has a front face, a back face, and at least one straight peripheral edge, and wherein at least one of said at least a first pair of transparent panels is an envelope which is adapted to receive at least one display card;

wherein each one of said at least a first pair of transparent panels is opposed to one another such that each of said at least one straight peripheral edges are opposed edges;

wherein said flexible living hinge is located along at least a portion of said at least one straight peripheral edge of each one of said at least a first pair of transparent panel, wherein said flexible living hinge is interposed between said at least one straight peripheral edge of each one of said at least a first pair of transparent panels, and wherein said at least one envelope of said at least a first pair of transparent panels is rotatable about said flexible living hinge;

wherein said protective display system is an unitary structure;

wherein said flexible living hinge has greater flexibility than each one of said at least a first pair of transparent panels; and wherein said at least a first pair of transparent panels comprises a first envelope and a second envelope, and wherein said flexible living hinge is interposed between said first and second envelopes;

said method comprising the steps of:

(1) placing said first envelope and said second envelope in a die such that said at least one straight peripheral edge of said first envelope is opposed to said at least one straight peripheral edge of said second envelope, and each of said envelopes is in the same plane;

(2) closing and heating the die to a temperature above the tempering temperature of said flexible living hinge, so as to interpose said flexible living hinge between said at least one straight peripheral edge of said first envelope and said at least one straight peripheral edge of said second envelope, wherein said at least one straight peripheral edge of said second envelope is opposed to said at least one straight peripheral edge of said first envelope, by the addition of a flexible PVC;

(3) opening and lifting the die after interposing said flexible living hinge between said respective at least one straight peripheral edge of each of said first and second envelopes, while said flexible living hinge remains above its tempering temperature;

(4) rotating one of said first and second envelopes about said flexible living hinge such that said back face of said first envelope is contiguous to said front face of said second envelope; and (5) cooling said protective display system and trimming the excess material from said flexible living hinge;

wherein the rotation of one of said first and second envelopes about said flexible living hinge is carried out while said flexible living hinge is above its tempering temperature, and so that after cooling, an elastic memory for said flexible living hinge is created, and said first and second envelopes are in the desired position;

whereby the elastic memory of said flexible living hinge is such that it encourages each of said first and second envelopes to return to the desired position after each of said first and second envelopes is rotated about said flexible living.

21. A method of making a protective display system, wherein said protective display system comprises:

at least a first pair of transparent panels and a flexible living hinge;

wherein each one of said at least a first pair of transparent panels has a front face, a back face, and at least one straight peripheral edge, and wherein at least one of said at least a first pair of transparent panels is an envelope which is adapted to receive at least one display card;

wherein each one of said at least a first pair of transparent panels is opposed to one another such that each of said at least one straight peripheral edges are opposed edges;

wherein said flexible living hinge is located along at least a portion of said at least one straight peripheral edge of each one of said at least a first pair of transparent panels, wherein said flexible living hinge is interposed between said at least one straight peripheral edge of each one of said at least a first pair of transparent panels, and wherein said at least one envelope of said at least a first pair of transparent panels is rotatable about said flexible living hinge;

wherein said protective display system is an unitary structure;

wherein said flexible living hinge has greater flexibility than each one of said at least a first pair of transparent panels; and wherein said at least a first pair of transparent panels comprises a first envelope and a second envelope, and wherein said flexible living hinge is interposed between said first and second envelopes;

said method comprising the steps of:

(1) placing said protective display system such that said first envelope, said second envelope, and said flexible living hinge are all located in the same plane;

(2) reheating said flexible living hinge to a temperature above its tempering temperature;

(3) rotating one of said first and second envelopes about said flexible living hinge such that said back face of said first envelope is contiguous to said front face of said second envelope;

(4) cooling said protective display system;

wherein the rotation of one of said first and second envelopes about said flexible living hinge is carried out while said flexible living hinge is above its tempering temperature, and so that after cooling, an elastic memory for said flexible living hinge is created, and said first and second envelopes are in the desired position;

whereby the elastic memory of said flexible living hinge is such that it encourages each of said first and second envelopes to return to the desired position after being rotated about said flexible living hinge.

* * * * *